US012098899B2

(12) United States Patent
Nicolajsen

(10) Patent No.: US 12,098,899 B2
(45) Date of Patent: Sep. 24, 2024

(54) RETAINER FOR CATCHING EJECTED CARTRIDGE CASES FROM SHOTGUNS

(71) Applicant: AARTHY APS, Risskov (DK)

(72) Inventor: Lars Galsgard Nicolajsen, Risskov (DK)

(73) Assignee: AARTHY APS, Risskov (DK)

( * ) Notice: Subject to any disclaimer, the term of this patent is extended or adjusted under 35 U.S.C. 154(b) by 0 days.

(21) Appl. No.: 18/250,463

(22) PCT Filed: Oct. 22, 2021

(86) PCT No.: PCT/EP2021/079395
§ 371 (c)(1),
(2) Date: Apr. 25, 2023

(87) PCT Pub. No.: WO2022/090088
PCT Pub. Date: May 5, 2022

(65) Prior Publication Data

US 2023/0400270 A1 Dec. 14, 2023

(30) Foreign Application Priority Data

Oct. 26, 2020 (DK) ..... PA 2020 01200

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98
See application file for complete search history.

(56) References Cited

U.S. PATENT DOCUMENTS

| | | | | |
|---|---|---|---|---|
| 7,536,821 | B1 * | 5/2009 | Saur | F41A 9/60 42/98 |
| 2012/0023803 | A1 * | 2/2012 | Taylor | F41A 9/60 42/90 |
| 2013/0074392 | A1 * | 3/2013 | McCaffery | F42B 39/02 224/183 |
| 2016/0313105 | A1 * | 10/2016 | Olroyd | F42B 39/02 |
| 2017/0082388 | A1 * | 3/2017 | Plourde | F41A 23/18 |
| 2021/0156644 | A1 * | 5/2021 | Mack | A47B 81/005 |
| 2022/0018631 | A1 * | 1/2022 | Strzalko | F41C 33/0218 |

FOREIGN PATENT DOCUMENTS

| | | | | |
|---|---|---|---|---|
| EP | 3 598 055 | A1 | 1/2020 | |
| GB | 2497861 | A * | 6/2013 | F41A 9/35 |

OTHER PUBLICATIONS

Ross Scott, "Neodymium magnet Hull Catcher, Browning Auto 5," YouTube, Jun. 30, 2017, XP054979049, Retrieved from the Internet: URL:https://www.youtube.com/watch?v=bjQ5dcb0cDM, retrieved on Jan. 18, 2019, 2 pages.

(Continued)

*Primary Examiner* — Bret Hayes
(74) *Attorney, Agent, or Firm* — Ware, Fressola, Maguire & Barber LLP

(57) ABSTRACT

A retainer is shown for catching ejected cartridge cases from shotguns. The retainer includes a) a base adapted for being mounted on a shotgun; and b) an elongate member adapted for being releasably fastened to the base. The elongate member includes i) a core of one or more magnets; and ii) a cover adapted for covering the core of one or more magnet(s).

14 Claims, 12 Drawing Sheets

(56) References Cited

OTHER PUBLICATIONS

Bpwvanleeuwen: "1 hulzenvanger cal 12 www.hulzenvanger.123website.nl", YouTube, Nov. 9, 2013 (Nov. 9, 2013), p. 2 pp., XP054979048, Retrieved from the Internet: URL:https://www.youtube.com/watch?v=fW1eQRIXmF8 [retrieved on Jan. 18, 2019], 1 page.
International Search Report (ISR), Application No. PCT/EP2021/079395, mailed Feb. 2, 2022, 3 pages.
Written Opinion of the International Searching Authority (ISA/EP), Application No. PCT/EP2021/079395, mailed Feb. 2, 2022, 5 pages.

* cited by examiner

RETAINER FOR CATCHING EJECTED CARTRIDGE CASES FROM SHOTGUNS

TECHNICAL FIELD OF THE INVENTION

The present invention relates to the field of shotguns, and more particularly to retainers for catching ejected cartridge cases.

BACKGROUND OF THE INVENTION

Various shotguns eject the spent cartridge cases after firing. These spent cartridge cases are scattered on the ground, and the task to collect all the empty cartridges is a challenge to an individual, especially when the shooter does not have the fixed position of firing. The empty cartridges are often made from plastic that degrades very slowly in nature, if at all. When hunting at sea or on a lake, the empty plastic cartridges end up in the water.

Also, the cartridges are ejected at high speed and can strike and injure a nearby person, posing a hazard. Thus, there is a need to design a secure and safe system to automatically collect the spent cartridge cases, after the firing.

Hence, there is a need for a simple solution for collecting the ejected cartridges.

DESCRIPTION OF THE INVENTION

A first aspect relates to retainer adapted for catching ejected cartridge cases from shotguns, said retainer comprising:

a base adapted for being mounted on a shotgun; and an elongate member adapted for being releasably fastened to said base;

wherein the elongate member comprises:

a core of one or more magnets; and a cover adapted for covering said core of one or more magnet(s).

The inventor has found that the brass head of the cartridge cases is magnetic, and by using a magnet positioned close to the ejection port, the magnet is able to catch an ejected cartridge case. Preferably, the magnet is a rear earth magnet. The rear earth magnet may be a samarium- or neodymium-alloy magnet. Preferably, the magnet is neodymium-based as it is less brittle than samarium-based magnets. The neodymium magnet may comprise neodymium, iron and boron, e.g., but not limited to $Nd_2Fe_{14}B$. $Nd_2Fe_{14}B$ exists in a tetragonal crystal structure. The tetragonal crystal structure can provide a high uniaxial magneto-crystalline anisotropy, which gives the magnet a very high coercivity or resistance to being demagnetized. The neodymium magnet may have a high magnetic dipole moment, which convers up to 18 times magnetic energy to the neodymium magnet as compared to ordinary iron-based magnets. Preferably, the neodymium magnet is coated with a polymeric material, such as plastic or rubber, to avoid oxidation. The samarium-based magnet may e.g., be a samarium-cobalt magnet. Both samarium-cobalt and neodymium magnet alloys are powdered metals, which are compacted in the presence of a strong magnetic field and are then sintered.

As the rear earth magnets create a very strong magnetic field, there is a risk that it interferes with the mechanics of the shotgun, thereby resulting in malfunction of the shotgun.

Hence, in one or more embodiments, the core comprises a plurality of magnets arranged to form a relatively weak magnetic field on one side of the elongate member, and a relatively strong magnetic field on the opposite side of the elongate member, and wherein the relatively strong magnetic field is facing away from the base. This configuration reduces the magnetic field's effect on the mechanics of the shotgun.

In one or more embodiments, the magnets are arranged as a Halbach array. A Halbach array is a special arrangement of permanent magnets that augments the magnetic field on one side of the array while cancelling the field to near zero on the other side. This is achieved by having a spatially rotating pattern of magnetization. The rotating pattern of permanent magnets (on the front face; on the left, up, right, down) can be continued indefinitely and have the same effect. FIG. 5 shows an example of such an array.

In one or more embodiments, the core is magnetically shielded with a shield at the side face facing towards the base. The design and material of the shield may be any suitable type well known in the field of magnetic shielding. An example of such a shield may be seen in FIGS. 6 and 7. Preferably, the shield may be designed of multiple layers of sheet metal, such as two or three layers, of ferromagnetic sheet metal.

The shield may also e.g., be made from a material having a high magnetic permeability, such as mu-metal or permalloy. However, such a material is very expensive. In general, "mu metal" as discussed herein is a nickel-iron ferromagnetic alloy (e.g., 75% nickel, 15% iron, plus copper and molybdenum) that has very high magnetic permeability. The high magnetic permeability makes mu-metal very effective at screening static or low-frequency magnetic fields, which cannot be attenuated by other methods. Mu-metal can have relative magnetic permeabilities of 80,000-100,000 compared to a few thousand for ordinary steel. Other high permeability alloys, such as permalloy (nickel-iron magnetic alloy), have similar magnetic properties, and may also be used, although it is more difficult to shape. The term "permalloy" refers to a nickel iron magnetic alloy. Generically, it refers to an alloy with about 20% iron and 80% nickel content (i.e., $Ni_{80}Fe_{20}$). Permalloy has a high magnetic permeability, low coercivity, near zero magnetostriction, and significant anisotropic magnetoresistance.

To make sure that the caught cartridge case is moved as far as possible away from the ejection port, it may be an advantage to shape the cover to support such a movement of the cartridge case around the elongate member.

In one or more embodiments, the cover is configured with a rounded top face, and optionally a rounded side face facing towards the base. The rounded shape makes it difficult for the cartridge case to rest on these faces. In combination with the directed magnetic field this effect is strengthened. Preferably, the cover is configured with a straight side face facing away from the base, thereby allowing for an optimal resting place for the brass head of the cartridge case.

When mounted on a shotgun, the elongate member is preferably adapted for being positioned substantially parallel to the barrel of said shotgun.

The base may be fastened to the shotgun by any suitable means for fastening, such as gluing, welding, or fastening with screws or bolts.

The retainer may be adapted for being used with different types of shotguns.

In one or more embodiments, the cover comprises fastening means adapted for being releasably fastened to the base.

In one or more embodiments, the elongate member, when fastened to the base, is configured for being moved relative to the base, e.g., slidable attached to the base.

In one or more embodiments, the elongate member comprises one or more flexible elongated rods or bristles adapted for reducing the speed of an ejected cartridge case. In the present context, the term "flexible" means that the member can be flexed or bent. The elongated rods or bristles preferably extends upwards relative to the top face of the cover, preferably from said top face. The elongated rods or bristles may be positioned at the rear end (relative to the shot gun) of the elongated member and/or may be positioned in line along the length of the elongated member. The number of elongated rods or bristles may vary depending on the type of cartridge, such as the caliber, or the size of the cartridge case. In some embodiments, a single elongated rod or group of bristles may be used.

Another aspect relates to a shotgun comprising the retainer according to the present invention.

Yet another aspect relates to the use of the retainer the retainer according to the present invention for mounting to a shotgun.

It should be noted that embodiments and features described in the context of one of the aspects of the present invention also apply to the other aspects of the invention.

As used in the specification and the appended claims, the singular forms "a", "an", and "the" include plural referents unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

DETAILED DESCRIPTION OF THE INVENTION

Figure 1:
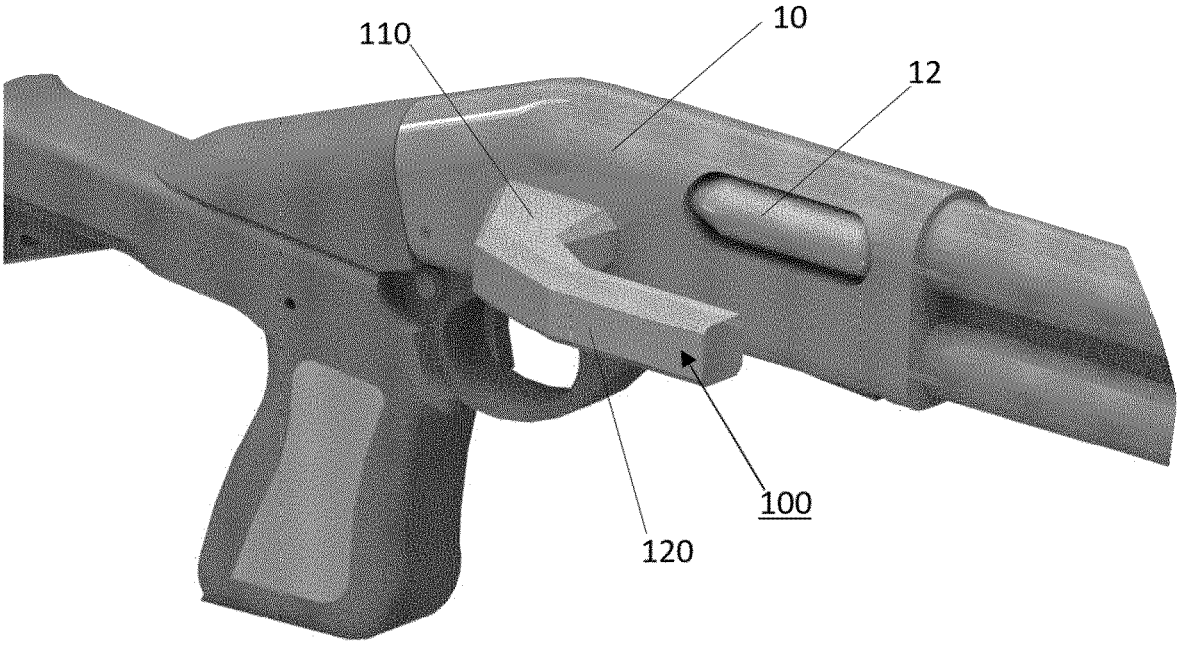
FIG. 1 shows a perspective view of a shotgun with a retainer mounted in accordance with various embodiments of the invention.

FIG. 1 shows a perspective view of a shotgun 10 with an ejection port 12. A retainer 100 is mounted in close relation to the ejection port 12. The retainer 100 is adapted for catching ejected cartridge cases 14 leaving the ejection port 12 during use and comprises a base 110 adapted for being mounted on a shotgun, and an elongate member 120 adapted for being releasably fastened to said base 110. 8. When mounted on the shotgun 10, the elongate member 120 is adapted positioned substantially parallel to the barrel of said shotgun 10.

Figure 2:
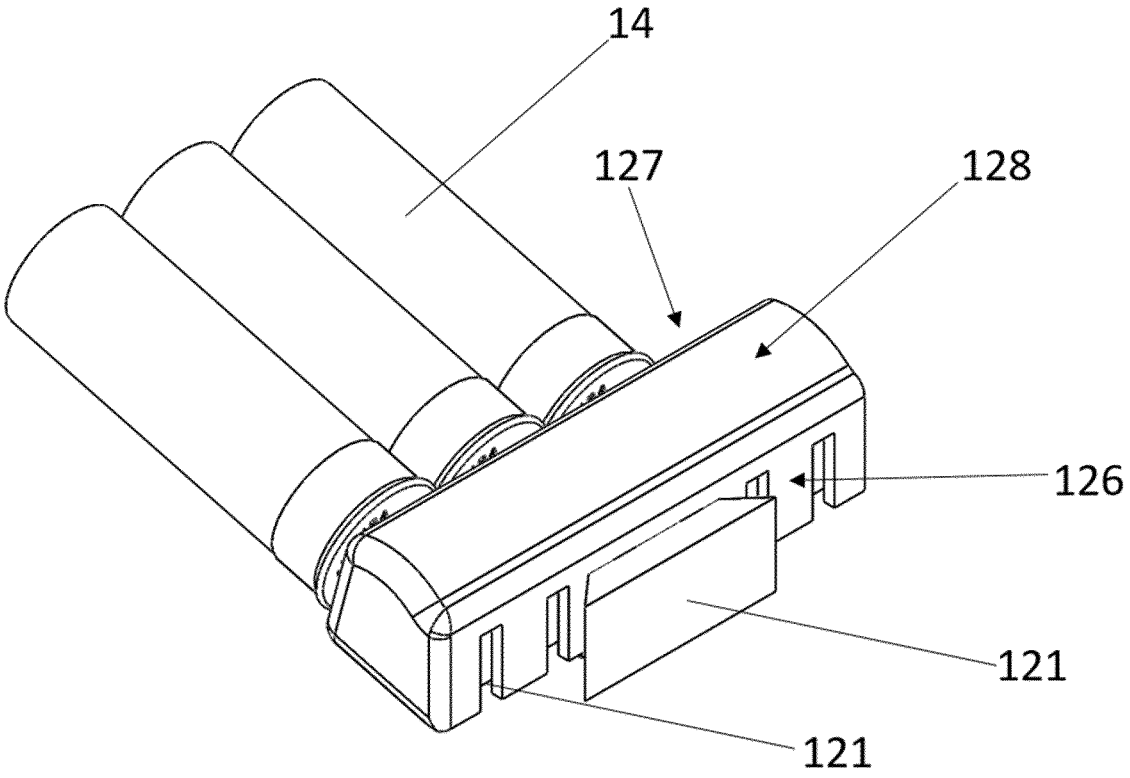
FIG. 2 shows a perspective view of a retainer in accordance with various embodiments of the invention, where the base is removed, and with three cartridge cases attached thereto.
Figure 3:
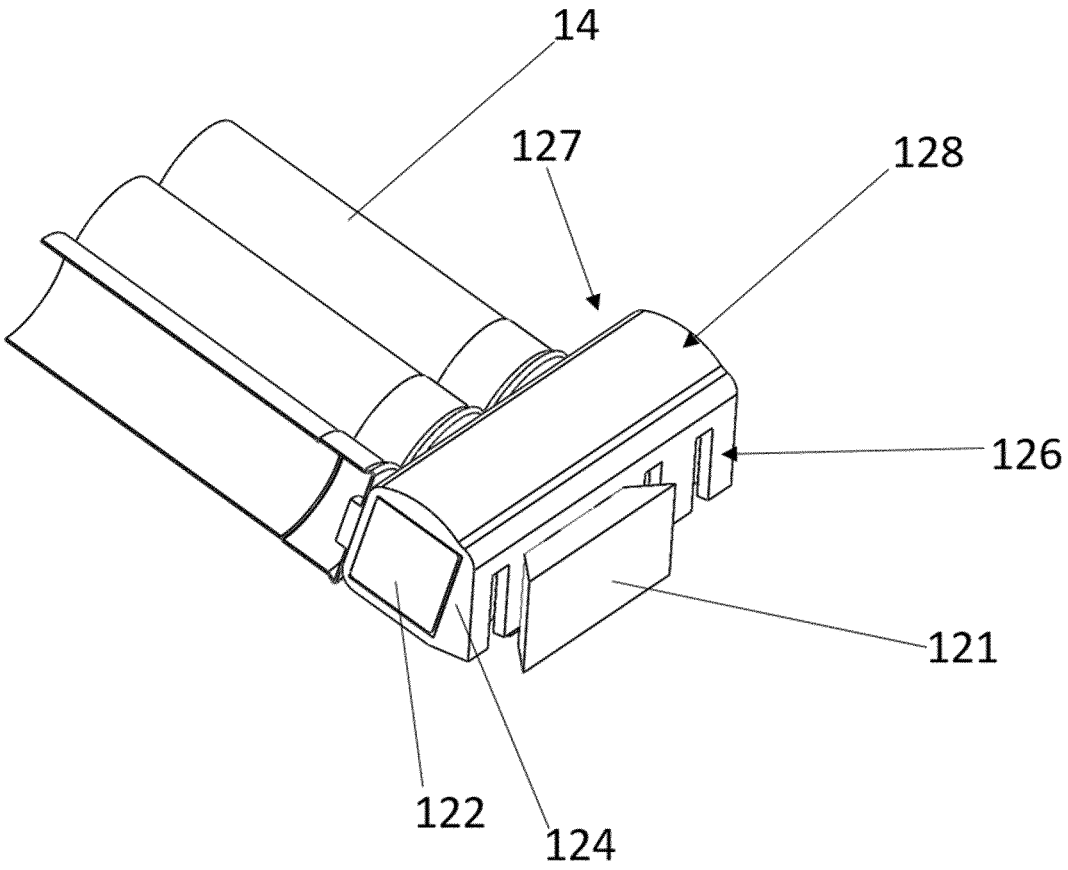
FIG. 3 shows a cross-sectional view of the retainer of FIG. 2.
Figure 4:
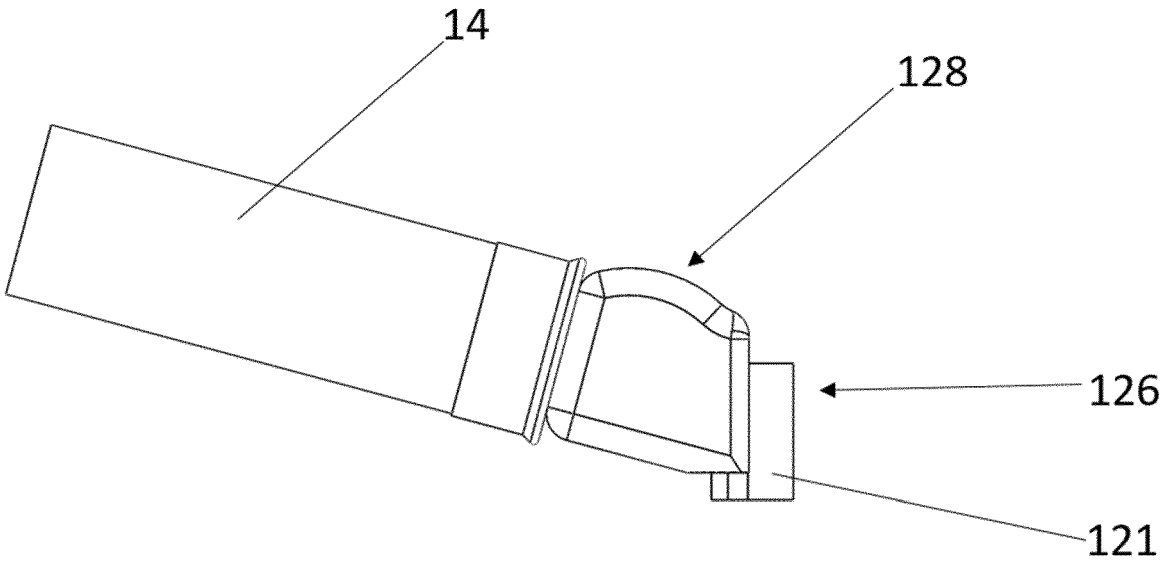
FIG. 4 shows an end view of a retainer in accordance with various embodiments of the invention, where the base is removed.

FIG. 2 shows a perspective view of a retainer in accordance with various embodiments of the invention, where the base is removed, and with three cartridge cases 14 attached to the elongate member. The elongate member 120 comprises (best seen in FIG. 3) a core 122, and a cover 124 covering said core 122. The cover 124 (FIGS. 2-4) is configured with a rounded top face 128, and a straight side face 127 facing away from the base 110. The cover 124 comprises fastening means 121 adapted for being releasably fastened to the base (not shown).

Figure 5:
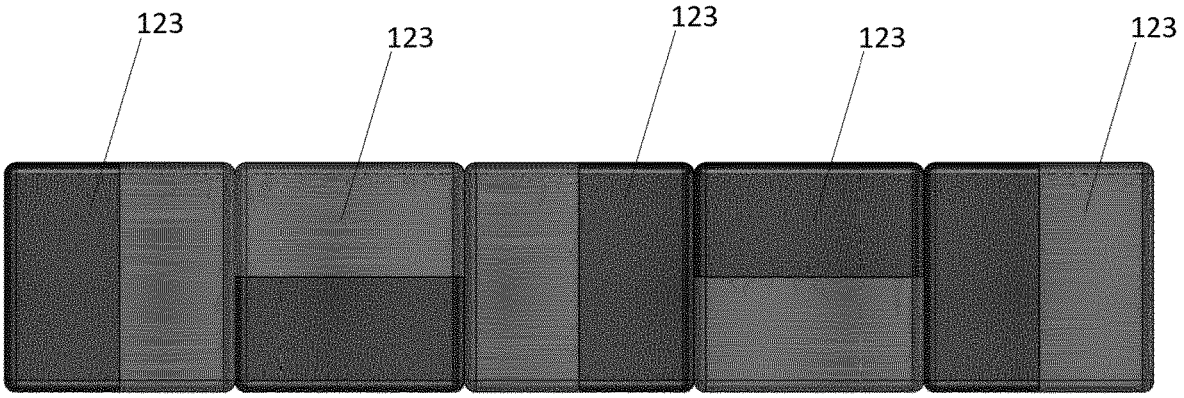
FIGS. 5-7 show examples of the core of the retainer in accordance with various embodiments of the invention.
Figure 6:
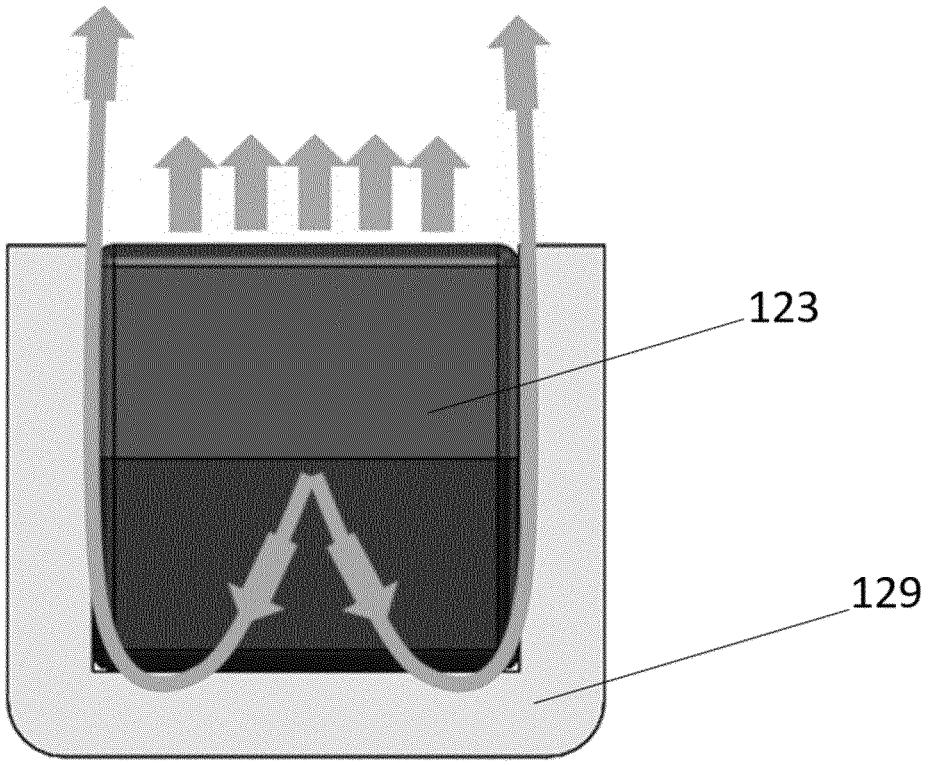
Figure 7:
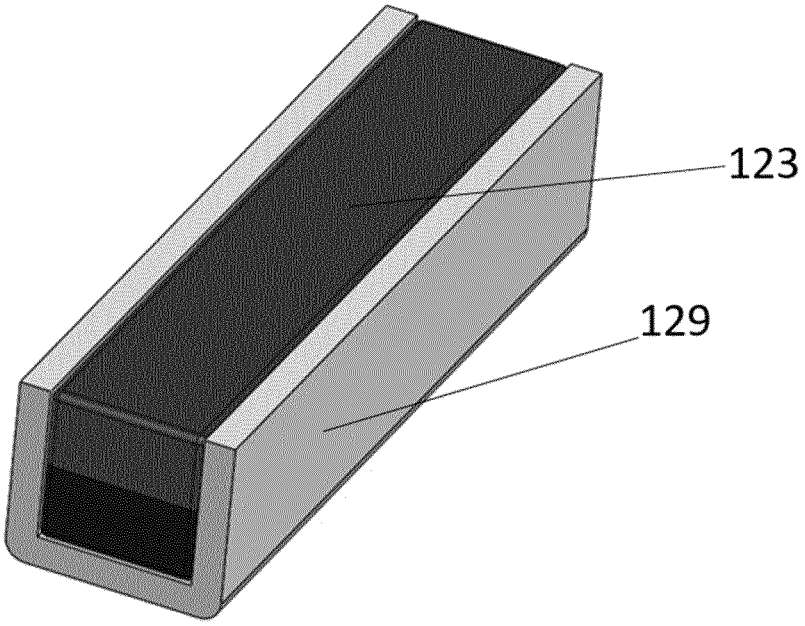

The core may comprise different constructions, and two different examples are shown in FIGS. 5-7. Both examples are arranged to form a relatively weak magnetic field on a first side of the elongate member, and a relatively strong magnetic field on the second opposite side of the elongate member. The core is positioned such that the relatively strong magnetic field is facing away from the base.

The first example (FIG. 5) represents a core comprising a plurality of permanent magnets 123 arranged as a Halbach array. The second example represents a core comprising one or more magnets 123, and where the magnets are magnetically shielded with a shield 129 at the side face 126 facing towards the base.

Figure 8:
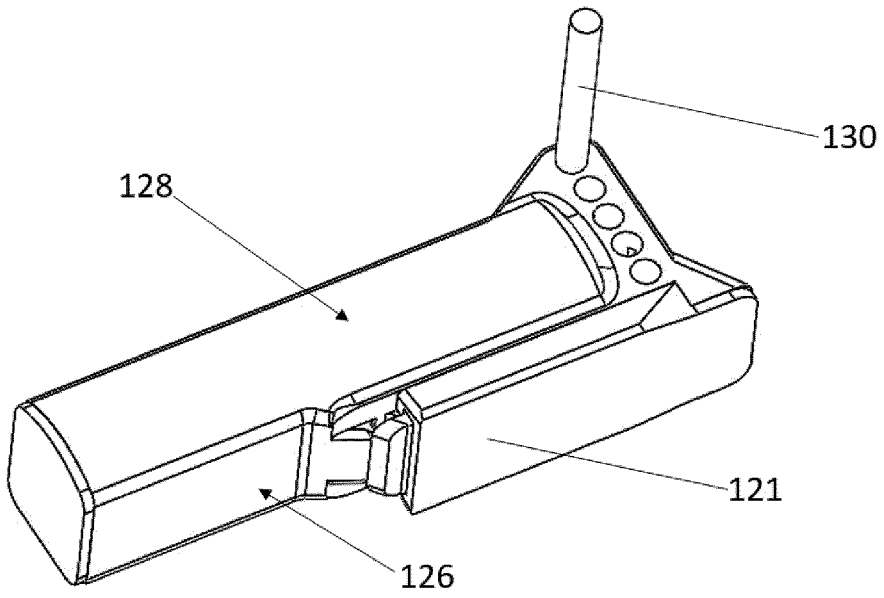
FIGS. 8-12 show examples of the position of elongated rods or groups of bristles on the elongate member.

FIGS. 8-12 show examples of the position of elongated rods or groups of bristles 130 on the elongate member 120. The elongated rods or groups of bristles 130 are present to reduce the speed of an ejected cartridge case (not shown), whereby the magnet can easier catch it. The number of elongated rods or bristles may vary depending on the type of cartridge, such as the caliber, or the size of the cartridge case. In FIG. 8, the elongate member 120 comprises a single flexible elongated rod or bristle 130. The elongated rod or bristle 130 extends upwards relative to the top face 128 of the cover.

Figure 9:
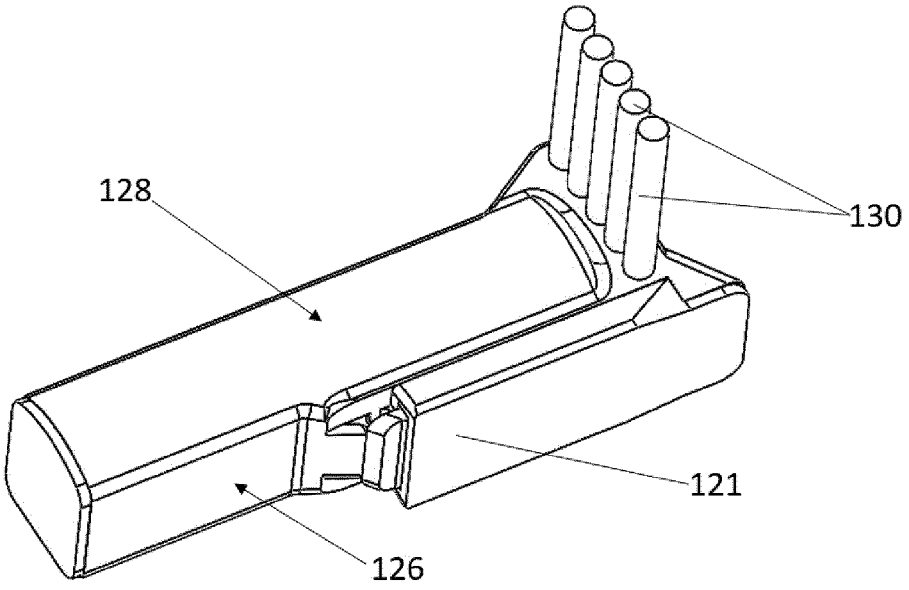
Figure 11:
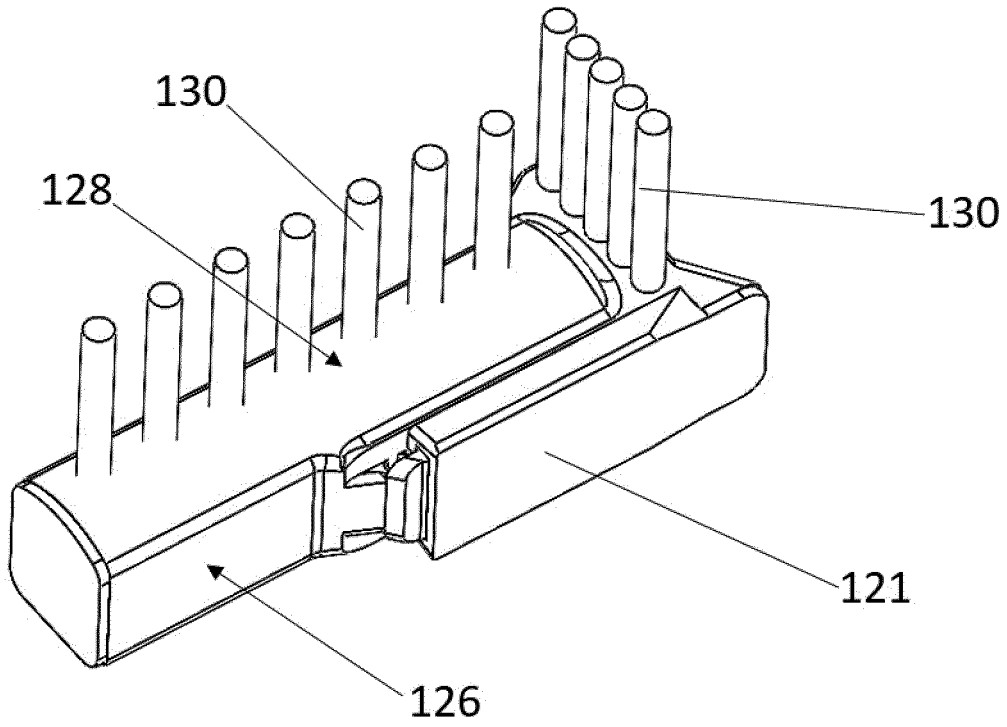

The elongated rods or bristles 130 may be positioned at the rear end (relative to the shot gun) of the elongated member as shown in FIGS. 8, 9, and 11.

Figure 10:
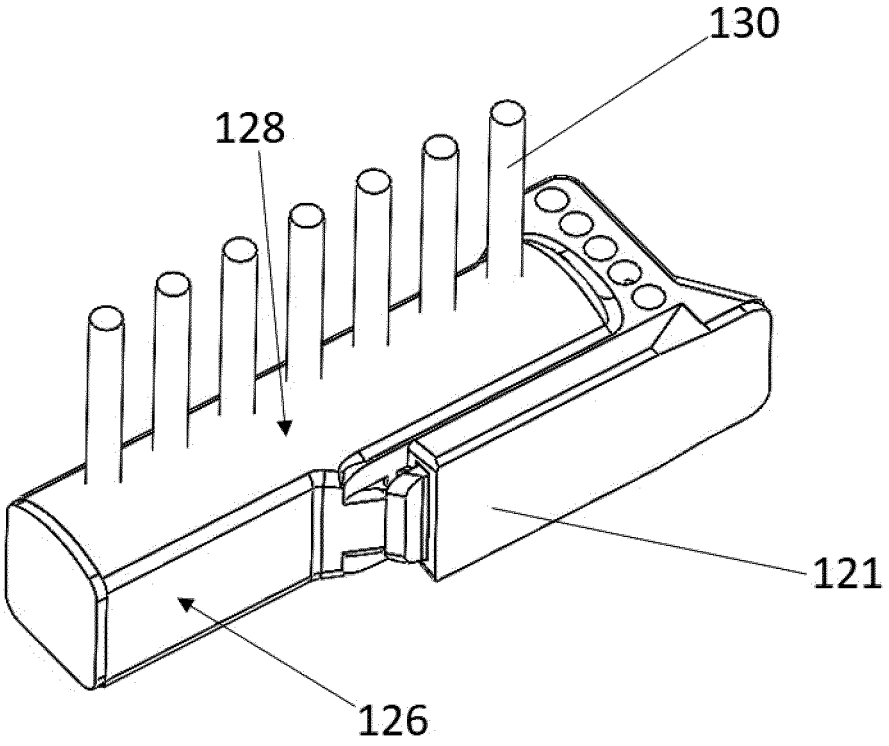
Figure 12:
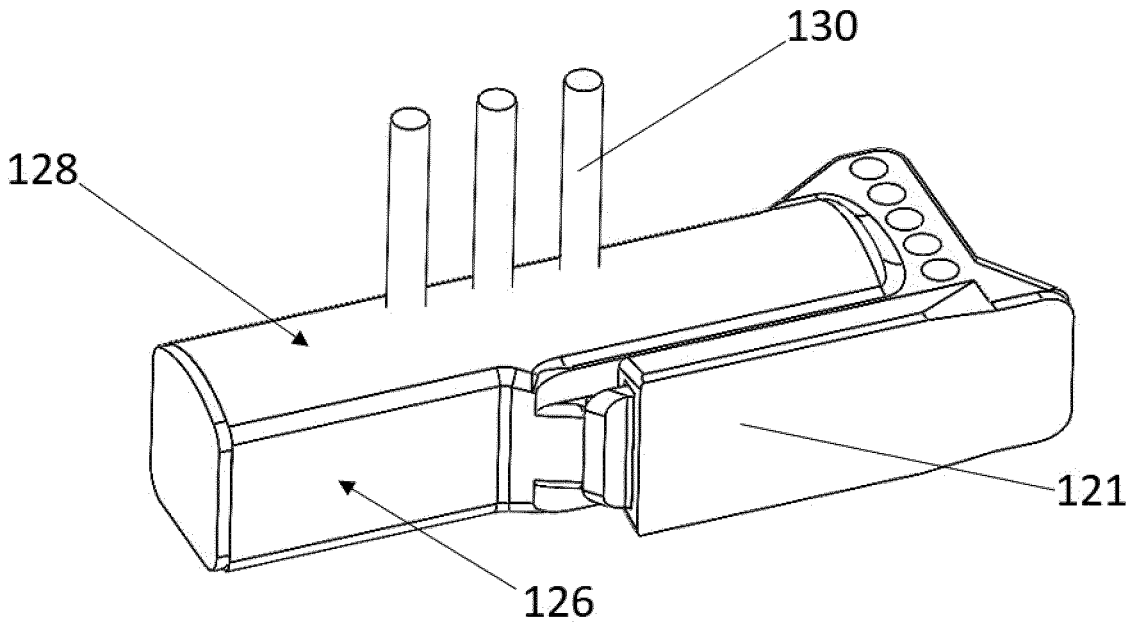

Alternatively, or in combination, they may be positioned in line along the length of the elongated member as shown in FIGS. 10-12.

REFERENCES

10 Shotgun
12 Ejection port
14 Cartridge case
100 Retainer
110 Base
120 Elongate member
121 Fastening means
122 Core
123 Magnet
124 Cover
126 First side/face of elongate member
127 Second side/face of elongate member
128 Top face of elongate member
129 Shield
130 Rod or bundle of bristles

The invention claimed is:

1. A retainer (100) adapted for catching ejected cartridge cases (14) from shotguns (10), said retainer (100) comprising:

a base (110) adapted for being mounted on a shotgun (10); and an elongate member (120) configured for releasable fastening to said base (110);

wherein the elongate member (120) comprises:

a core (122) of one or more magnets (123); and a cover (124) configured for covering said core (122) of one or more magnets (123), wherein the one or more magnets (123) comprise a plurality of permanent magnets arranged in an arrangement of the plurality of magnets so as to form a relatively weak magnetic field on a first side face (126) of the cover (124) of the elongate member (120), and a relatively strong magnetic field on a second, opposite side face (127) of the cover (124) of the elongate member (120), and wherein the relatively strong magnetic field is facing away from the base (110), wherein the plurality of permanent magnets are arranged as a Halbach array, wherein the cover (124) is configured with a rounded top face (128) so that the first side face (126), the second, opposite side face (127), and the rounded top face (128) combine to cover the plurality of magnets.

2. The retainer (100) according to claim 1, wherein the elongate member (120) comprises one or more flexible elongated rods or bristles (130) configured to reduce speed of an ejected cartridge case (14) and ease catching by the core of one or more magnets.

3. The retainer (100) according to claim 1, wherein the cover (124) comprises fastening means (121) adapted for being releasably fastened to the base (110).

4. The retainer (100) according to claim 1, wherein the base (110) is fastened to the shotgun (10) by gluing, welding, or with screws or bolts.

5. The retainer (100) according to claim 1, positioned substantially parallel to a barrel of said shotgun (10).

6. The retainer (100) according to claim 1, wherein the elongate member (120), when fastened to the base (110), is configured for movement relative to the base (110).

7. The retainer (100) according to claim 1, wherein the plurality of magnets (123) comprises rare earth magnets.

8. A shotgun comprising the retainer (100) according claim 1.

9. A method comprising mounting the retainer (100) according to claim 1 to a shotgun.

10. A retainer (100) adapted for catching ejected cartridge cases (14) from shotguns (10), said retainer (100) comprising:

a base (110) adapted for being mounted on a shotgun (10); and an elongate member (120) configured for releasable fastening to said base (110);

wherein the elongate member (120) comprises:

a core (122) of one or more magnets (123); and a cover (124) configured for covering said core (122) of one or more magnets (123), wherein the one or more magnets (123) comprise a plurality of permanent magnets arranged in an arrangement of the plurality of magnets so as to form a relatively weak magnetic field on a first side face (126) of the cover (124) of the elongate member (120), and a relatively strong magnetic field on a second, opposite side face (127) of the cover (124) of the elongate member (120), wherein the relatively strong magnetic field is facing away from the base (110), wherein the core (122) is magnetically shielded with a shield (129) at the first side face (126), and wherein the cover (124) is configured with a rounded top face (128) so that the first side face (126), the second, opposite side face (127), and the rounded top face (128) combine to cover the plurality of magnets.

11. The retainer (100) according to claim 10, wherein the shield (129) is made from multiple layers of sheet metal.

12. The retainer (100) according to claim 10, wherein the shield (129) is made from a material having a high magnetic permeability.

13. The retainer (100) according to claim 10, wherein the cover (124) is configured with the second, opposite side face (127) having a straight shape facing away from the base (110).

14. The retainer (100) according to claim 10, wherein the elongate member (120) comprises one or more flexible elongated rods or bristles (130) configured to reduce speed of an ejected cartridge case and ease catching by the core of one or more magnets, wherein said elongated rods or bristles (130) extend upwards relative to the rounded top face (128) of said cover (124).

* * * * *